US005951210A

United States Patent [19]

Maguire et al.

[11] Patent Number: 5,951,210

[45] Date of Patent: Sep. 14, 1999

[54] CONCRETE BLOCK

[75] Inventors: William H. Maguire, West Bay Shore; Roberto L. Nicolia, West Islip; Vito Picone, Commack, all of N.Y.

[73] Assignee: Nicolock of Long Island, Lindenhurst, N.Y.

[21] Appl. No.: 08/820,443

[22] Filed: Mar. 12, 1997

[51] Int. Cl.[6] ..... E02D 29/02

[52] U.S. Cl. ..... 405/286; 52/582.5; 52/604; 405/284

[58] Field of Search ..... 405/286; 52/604, 52/592.5, 592.6, 590.2

[56] References Cited

U.S. PATENT DOCUMENTS

| | | | |
|---|---|---|---|
| 468,838 | 2/1892 | Steiger | 52/592.5 |
| 3,534,518 | 10/1970 | Zagray | 52/592.5 X |
| 4,860,505 | 8/1989 | Bender | 52/596.6 |
| 5,064,313 | 11/1991 | Risi et al. | 405/284 |
| 5,457,926 | 10/1995 | Jensen | 52/604 |
| 5,505,034 | 4/1996 | Dueck | 405/286 X |
| 5,653,558 | 8/1997 | Price | 405/286 X |
| 5,678,958 | 10/1997 | Rossi | 405/286 |
| 5,704,183 | 1/1998 | Woolford | 405/286 X |

*Primary Examiner*—Dennis L. Taylor
*Attorney, Agent, or Firm*—Bauer & Schaffer, LLP

[57] ABSTRACT

Shaped concrete blocks are provided each having generally parallel top and bottom surfaces, a shaped front face (adapted to be exposed as the wall element), side walls and a rear wall. The one surface of each block is provided with shallow parallel grooves, while the other surface of each block is provided with rows of projecting knobs respectively positioned correspondingly with the grooves. In this manner, successive blocks may be stacked on top of one another with the knobs engaging the grooves.

9 Claims, 4 Drawing Sheets

Fig. 5
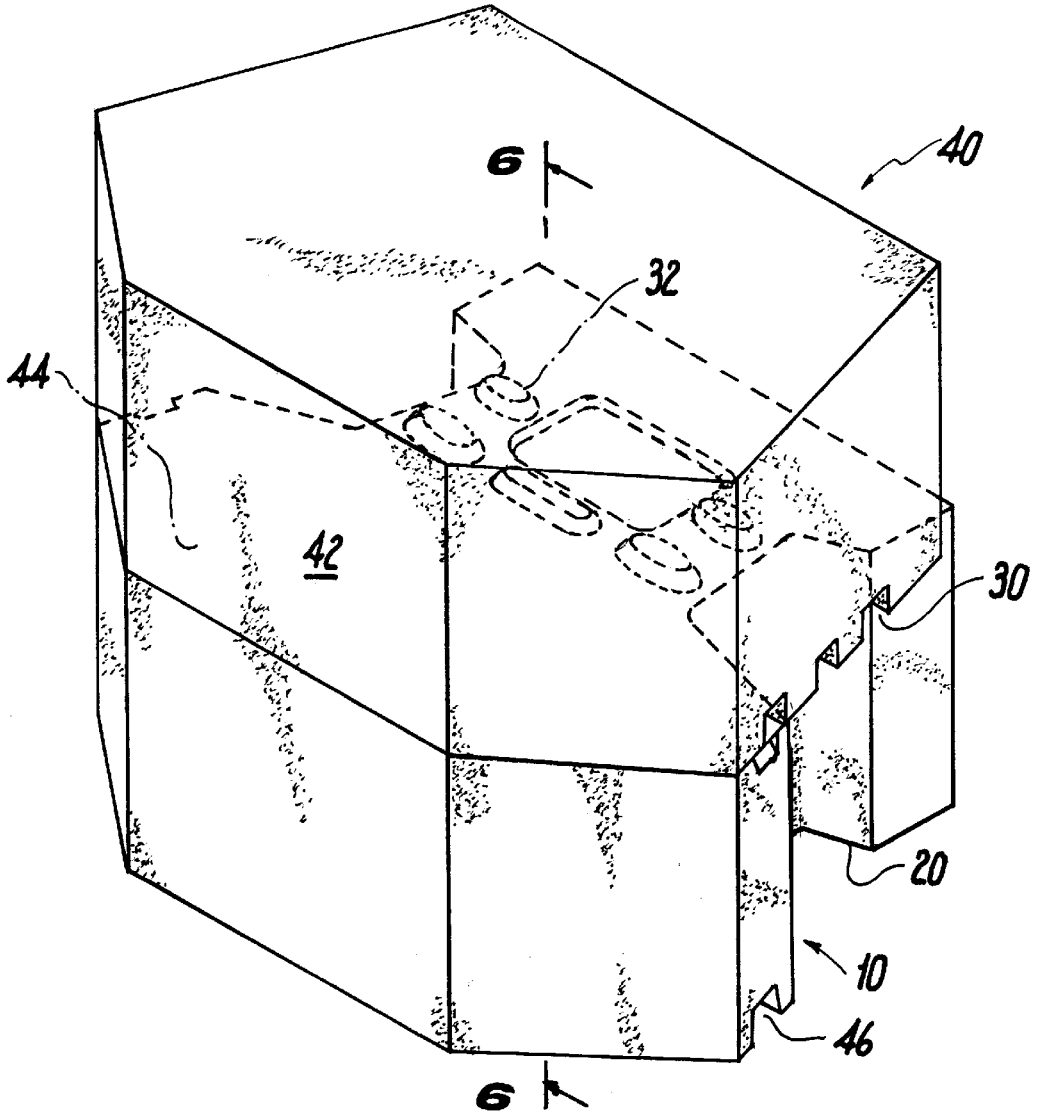
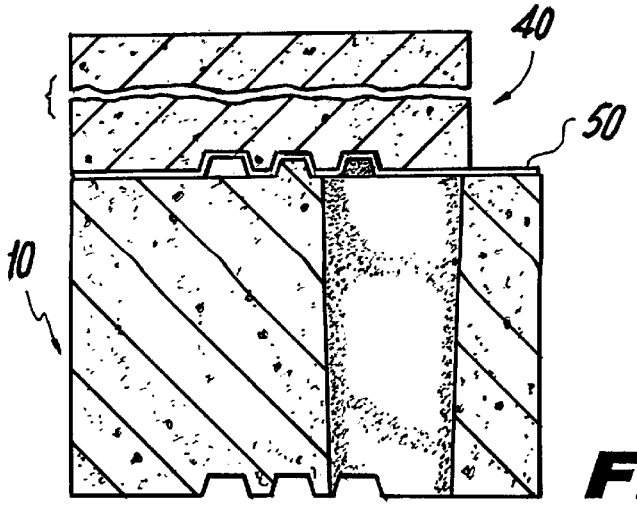
Fig. 6

CONCRETE BLOCK

BACKGROUND OF THE INVENTION

The present invention relates to the manufacture of concrete paving blocks for erecting retaining walls, and in particular, to the creation of selectively shaped retaining walls made from a plurality of such blocks.

Retaining walls are necessary to secure soil embankments adjacent roadways, streets, rail lines etc. from sliding or giving way as a result of rain or other shifts in terrain. Traditionally, such walls have been constructed from concrete, bricks, wood ties and other similar materials piled or erected to form a wall behind which earth is back filled. With the ability of molding and casting concrete paving blocks, rather inexpensively, a number of improved retaining wall systems have been suggested.

An example of a retaining wall using block elements is shown in U.S. Pat. No. 4,825,619 to Forsberg. In this patent, there is disclosed the formation of blocks that can be placed side by side and stacked on top of each other to form a wall of multiple courses. Each of the blocks is provided with holes that allow pins to be driven through the block into corresponding holes in the block of the underlying course. In this manner, subsequent courses are secured to preceding ones as the wall is erected. This type of construction requires significant on-site labor, careful alignment of the blocks as well as the securing of each block element with the aforementioned pins.

The aforementioned patent is just one of series of patents obtained by Mr. Forsberg, each seemingly depicting a differ facial design and overall shape, but each requiring pins in order to obtain the necessary interlocking of the stacked blocks. Reference can be made to design Pat. Nos. D.300, 253; D.311,444 and D.298,463.

The individual blocks are cast in modular form generally using a conventional block molding machine. After casting and curing, the blocks are bundled, wrapped and piled on shipping pallets for storage and ultimate transport to the project site. It has been found that the conventional blocks are difficult to strap and palletize and require excess handling. Moreover, the stacking, palleting and transporting of the known blocks are difficult and costly, requiring excessive care to see that the blocks do not shift in travel.

In addition to the difficulty in interlocking and stacking blocks, the individual blocks such as those of Forsberg lack versatility in the creation of pleasing arrangements of retaining wall designs. For example, notwithstanding the large number of design patents, Forsberg cannot erect a retaining wall having an arc radius of less than 20 feet. Thus, the retaining walls erected by Forsberg are essentially straight walls. Secondly, the step-back of a Forsberg retaining wall is severely limited and steep sloped walls are almost impossible.

It is an object of the present invention to provide a concrete block for erecting retaining walls overcoming the disadvantage of the prior art blocks.

It is, therefore, the object of the present invention to provide a concrete block that can be easily stacked to form a secure retaining wall with minimal labor and cost.

It is a further object to provide a wall block that can be stacked as to form a straight, circular or stepped-back walls.

It is a further object of the present invention to provide a wall block that can be easily stacked and secured for shipping.

These objects, together with other objects and advantages, will be apparent from the following disclosure of the present invention.

SUMMARY OF THE INVENTION

According to the present invention, shaped concrete blocks are provided each having generally parallel top and bottom surfaces, a shaped front face (adapted to the exposed as the wall element), side walls and a rear wall. The bottom surface of each block is provided with shallow parallel grooves, while the upper surface of each block is provided with rows of projecting knobs respectively positioned correspondingly with the two grooves.

Successive blocks may be stacked one on top of another with the knobs on the lower block engaging within the grooves on the lower surface of the upper block. For vertical stacking, the knobs and grooves are each engaged so that the frontal faces of the blocks are vertically aligned. For an inclined or laid back wall to be created, successive courses are offset, front to rear, so that at least one set of grooves and knobs remain interlocked. In this manner, the blocks can be arranged in various wall constructions, being fully interlocked and incapable of shifting under load conditions. The interlocking of the stacked blocks also insures secure stacking and palleting for shipment and travel.

Full details of the present invention are set forth in the following description and illustrated in the accompanying drawings.

BRIEF DESCRIPTION OF THE DRAWINGS

In the drawings

FIG. 5 is a perspective view of the coping unit; and

FIG. 6 is a sectional view taken along lines 6—6 of FIG. 5.

DESCRIPTION OF THE INVENTION

Figure 1:
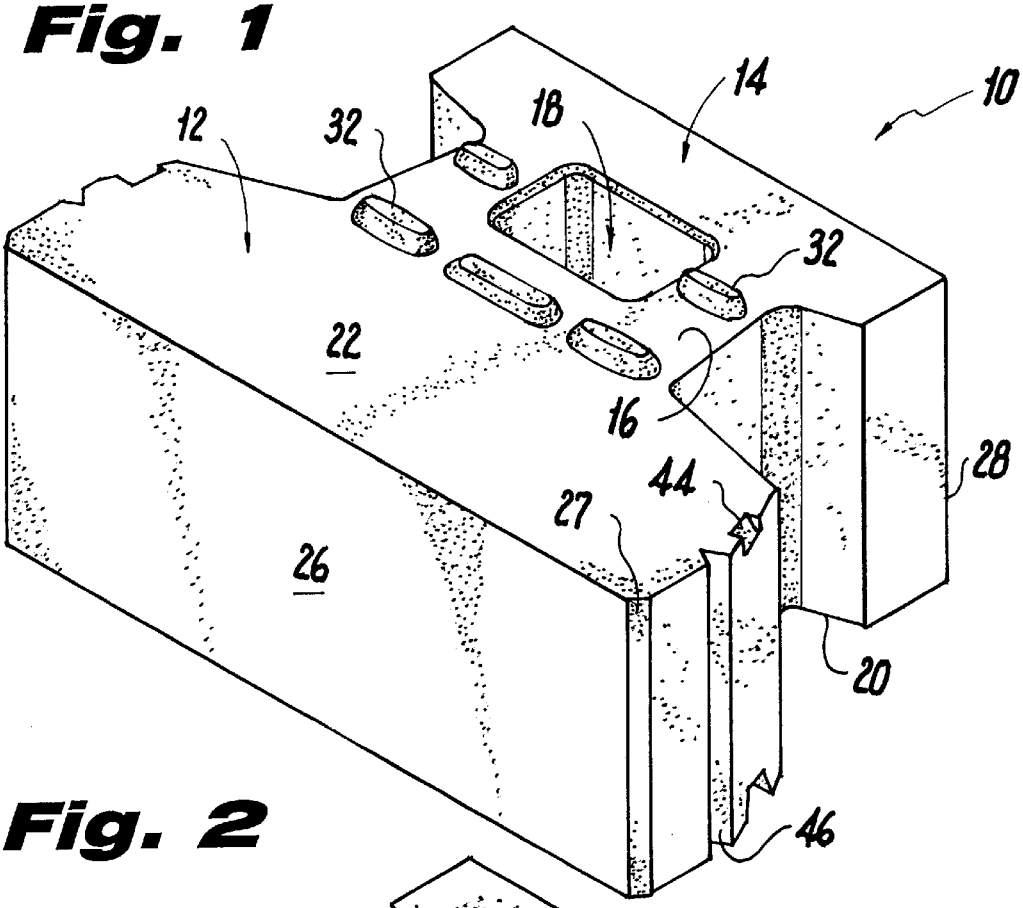
FIG. 1 is an isometric view of the block with a flat frontal face.
Figure 2:
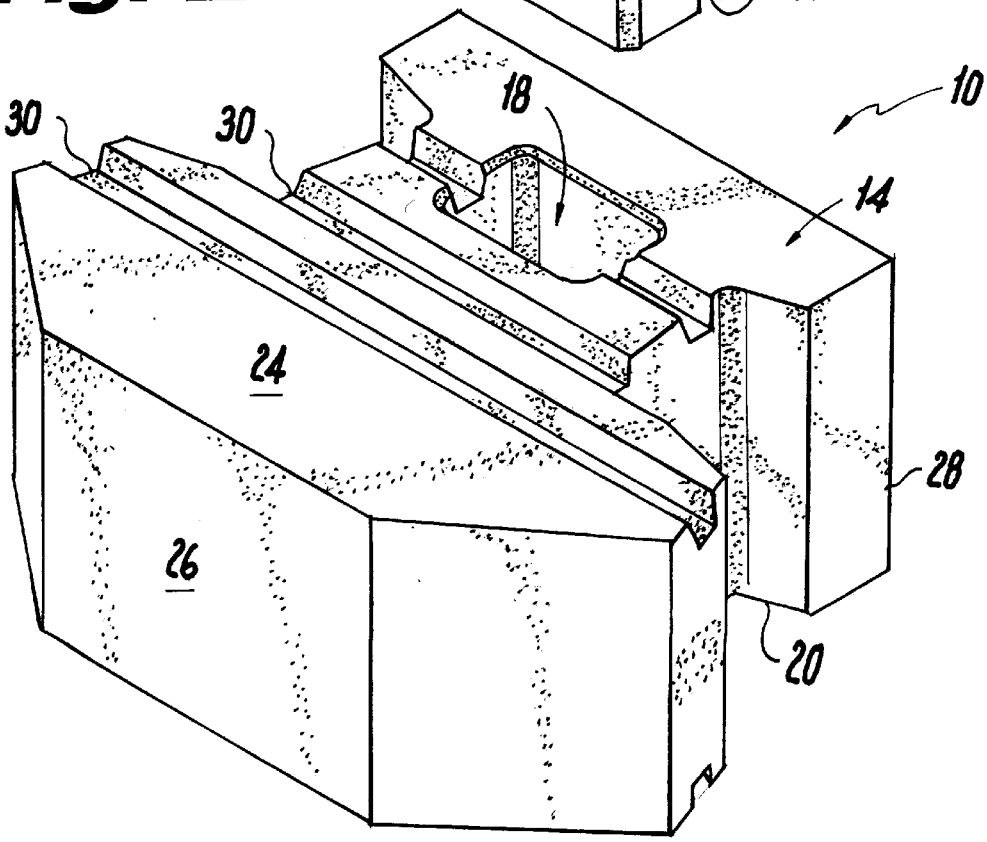
FIG. 2 is an isometric view of the block with a beveled frontal face.

Referring to FIGS. 1 and 2, the block, according to the present invention, is generally depicted by the numeral 10. The block 10 comprises an integrally formed body having an overall keystone shape, that is, having a solid forward portion 12, a solid rear portion 14 and a connecting intermediate web portion 16. The body 10 is of uniform thickness from top to bottom, bust somewhat tapered from front to rear, the rear portion 14 being slightly smaller widthwise than that of the forward portion 12. The connecting intermediate web portion 16 is formed with one or more holes 18 and cut out side wall portions 20 which reduce the bulk and weight of the block and provide the keystone shape.

The top and bottom surfaces 22 and 24 respectively, are smooth and parallel to each other, being provided with a flat frontal face 26 as seen in FIG. 1 or shaped as in FIG. 2. The frontal face may be worked so as to provide it with a textured surface simulating a stone or brick face. The edges of the frontal face may be beveled as at 27 in FIG. 1 or left square as seen in FIG. 1. The rear face 28 of the block is generally parallel to the front face 26, but does not need to be worked or textured as it normally will be hidden in the wall by the back fill.

The bottom surface 24, as seen in FIG. 2, is provided with their grooves 30 passing from side to side in a generally uniformly spaced parallel manner. The top surface 22 is provided with two rows of spaced upwardly extending knobs. The distance between the rows of knobs 32 being equal to the distance between the grooves 30. Thus, when one block is placed on the other, the knobs will register with and interlock within the grooves, the abutting top and bottom faces being flush with each other.

The knobs 32 are preferably of an oval shape so that they fit lengthwise in the groove 30. The knobs 32 may also be somewhat larger at their base so as to fit wedge-like in the grooves. While as will be seen, oval knobs have a distinct advantage, their shape may be round.

Preferably, there are three grooves 30 and two rows of knobs 32. In this manner, the blocks 10, when placed one over the other, can be staggered front to rear in laid back fashion so as to form an inclined wall. The number of grooves and rows of knobs may be increased provided there is always one more groove than a row of knobs, provided, of course, that sufficient knobs and grooves interlock.

Along the upper and lower side edges, there are formed indents 34 which will hold wire binding straps (not shown) by which a plurality of blocks can be bound together for palleting subsequent storage and shipment. In this manner, the stacked blocks can be safely shipped without any shifting or sliding, thereby eliminating damage commonly associated with the shipping of the prior art blocks.

It may be sometime desirable to provide a vertical groove 36 in the side wall of the front portion 12. The groove, as will be seen, enables abutting blocks to closely contact each other when arranged in a curved or circular manner.

The blocks 10 are preferably molded or cast of concrete by the conventional methods and materials utilizing any block (concrete) making machine. It is well known that in the casting of concrete blocks, color can be added by way of pigmentation or by the addition of colored aggregate. Similarly, it is known to make blocks of different density. Reference to the known prior techniques can be made here as if the same have been fully disclosed.

Figure 3:
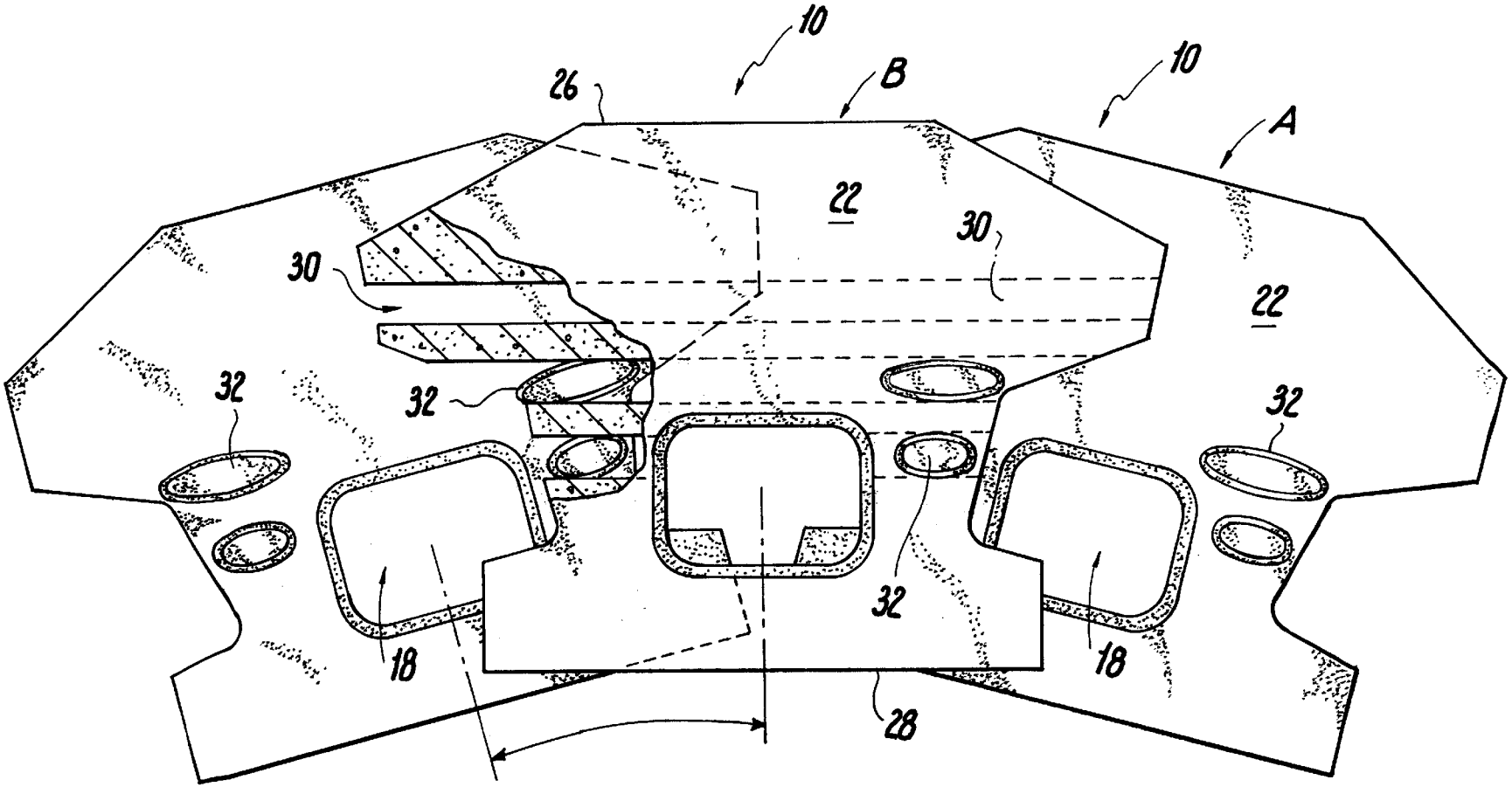
FIG. 3 is a top view of the several blocks in engagement.

The simple stacking of the blocks, two or more courses A and B, is illustrated in FIG. 3. In conventional manner, stacked courses are erected in conventional manner by abutting in each course, the blocks, side by side, with the subsequent upper course placed in the same way but offset or laterally staggered so that in each successive course, the upper block overlaps two adjacent blocks in the course directly below. In the staggered position, the block in the upper course overlaps half of each one of two lower blocks. The knobs 32 in the lower blocks seat firmly in the grooves 34 of the upper block. The oval shaped knobs 32 wedge firmly in the grooves.

Since only the knobs 32 adjacent the abutting side edges of the lower blocks A sit in the grooves of the same upper block B, the lower blocks may be arranged in arcuate path, producing an outer convex curve wall and a smaller concave curve in the wall. Of course, the block may be arranged to have a straight direction without any curve.

Because of the shaped configuration of the blocks, the blocks may be curved as that the upper and lower blocks are offset at an angle as small as 150 thereby enabling a wide range of radius in erecting the retaining wall.

A vertically straight wall is constructed by laying each course along a straight line and having the knobs contained on the top surface of one block element engage with the grooves provided on the bottom surface of the upper corresponding block as seen in FIG. 3, so that the front and rear faces are vertically aligned.

A laid back or inclined wall may be constructed by selectively altering the relationship of the knobs of the lower block with the grooves the upper block. Specifically, to construct a laid back wall, the two rows of knobs 32 of the underlying block element are inserted into the first and second grooves 30 of the overlying block, thus acting to step the frontal face of the upper block backward in an inclined manner.

Figure 4:
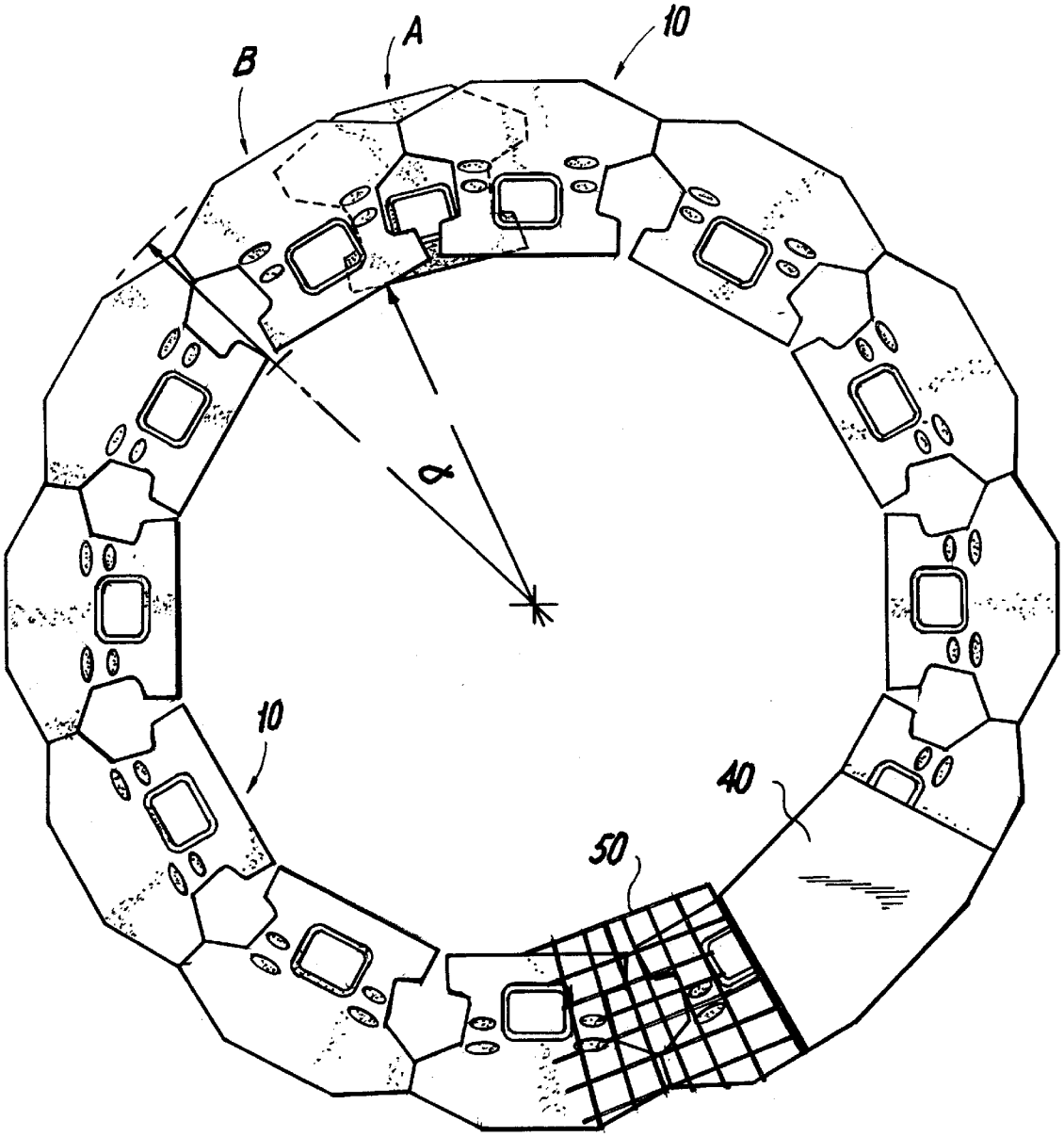
FIG. 4 is a top view of a circular wall constructed according to the present invention.

A circular wall, as seen in FIG. 4, may be constructed by the continual building of a wall in the manner shown in FIG. 3, selecting the radius of curvature of the exterior and interior frontal and rear faces, respectively to the size of the circular wall desired.

Often during the construction of high walls, it is necessary to utilize a reinforcing grid of plastic or fiber placed between the stacked blocks. Preferably, a flexible polymer plastic grid is inserted between the blocks so as to hang over at its rear to be embedded in fill material such as coarse sand or pea gravel. The knobs 32 pass through the grid which is then securely held against removable. In this manner, higher walls can be reinforced improving their overall strength.

As seen from the foregoing, the disadvantage of the prior art system using pin connectors are overcome. Any tendency to shear flexible grid material 50 rendering the wall structurally unsafe is avoided by eliminating the pin connections found in the prior art, the present invention significantly improves the effectiveness of reinforcing grids. The larger knob elements of the present invention displace the shearing force over a larger area, reducing the shear stress experienced by the grid. As such, the structural integrity of the grid material is preserved, thereby improving the overall strength of the wall.

As seen in FIG. 5, a coping unit 40 is provided which may be used to finish the top edge of the wall. The coping unit is provided with a frontal face 42 and a bottom surface 44. The bottom surface 44 is also provided with grooves 30, which are adapted to resiliently receive the knobs 32 provided in the uppermost block. In this manner, the coping unit is secured to the uppermost block element of the wall to provide a flush upper surface coping section, a recessed coping section, or a drip edge. In addition, the coping unit may be provided with an angled frontal face 46 to allow the coping to curve as required for a circular wall. The cross section of FIG. 6 shows a grid 50 placed between the coping 40 and the block 10.

It is also seen that the present invention provides an improved, inexpensive concrete block of lighter weight, but sufficiently strong to erect high retaining walls. The provision of shaped, preferably, oval knobs and elongated grooves eliminates the need for using pins, which can easily crack and destroy the retaining walls. The knobs and grooves also provide increased strength.

The provision of multiple rows of knobs and grooves enables the construction of inclined walls in an easy but safe manner. The rows of each permit staggering or stepping of successive courses. The provision of at least one extra groove relative to knobs permits stepped or laid back walls of a wide angular range.

Various modifications and changes have been disclosed herein and others will be apparent to those skilled in the art. Therefore, it is to be understood that the present disclosure is by way of illustrating an not limiting the present invention.

What is claimed is:

1. A block for erecting retaining walls comprising a body having front and rear walls, top and bottom walls, and side walls, one of said top and bottom walls of said block being provided with a row of shaped knobs extending outwardly therefrom and the other wall being provided with atleast one continuous groove extending from side wall to side wall, said knobs having a shape adapted to seat within a respective one of said grooves when one block is placed over the other such that said knobs are firmly lodged within said groove even when said blocks are placed with their said front faces at an angle one to another, said angle being variable, and permit said blocks to move relatively to each other in line with said groove.

2. The block according to claim 1, wherein at least one more groove than rows of knobs are provided.

3. The block according to claim 2, wherein two rows of knobs and three rows of grooves are provided.

4. The block according to claim 1, wherein said knobs are oval such that the elliptic shape of the knobs enables them to firmly lodge within said groove even when said blocks are placed such that their said front faces are at an angle one to another.

5. The block according to claim 1, wherein said knobs extend outwardly in conical shape such that the tapered shape of the knobs enables them to lodge firmly within said groove even when said blocks are placed such that their front faces are at an angle one to another, and such that said angle can vary.

6. The block according to claim 1, wherein the side walls are tapered from front to rear so that said rear wall is smaller widthwise than said front wall.

7. The block according to claim 1, wherein the edges of the side walls are indented to provide seats for a binding strap.

8. The block according to claim 1, wherein the side wall is provided with a vertical groove whereby abutting blocks can be interconnected in a curved path.

9. A retaining wall comprising successive courses of blocks stacked one course on top of another, each of said blocks being formed according to any one of claims 1–6 and 7–8, and wherein the blocks of each course abut one another and the said knobs and grooves are interlocked.

* * * * *